US006439479B1

(12) United States Patent
Jönsson

(10) Patent No.: US 6,439,479 B1
(45) Date of Patent: Aug. 27, 2002

(54) SPRAY GUN

(75) Inventor: Peder Jönsson, Mölndal (SE)

(73) Assignee: Aplicator System AB (SE)

( * ) Notice: Subject to any disclaimer, the term of this patent is extended or adjusted under 35 U.S.C. 154(b) by 0 days.

(21) Appl. No.: 09/403,604

(22) PCT Filed: Apr. 17, 1998

(86) PCT No.: PCT/SE98/00704

§ 371 (c)(1),
(2), (4) Date: Dec. 8, 1999

(87) PCT Pub. No.: WO98/47625

PCT Pub. Date: Oct. 29, 1998

(30) Foreign Application Priority Data

Apr. 23, 1997 (SE) ..... 9701541

(51) Int. Cl.[7] ..... A62C 5/02

(52) U.S. Cl. ..... 239/310; 231/407; 231/414; 231/584

(58) Field of Search ..... 239/306–308, 239/310, 398, 401, 407, 413, 414, 415, 418, 584

(56) References Cited

U.S. PATENT DOCUMENTS 3,561,680 A * 2/1971 Ott ..... 239/413
3,920,158 A 11/1975 Meshberg ..... 222/135
4,582,224 A 4/1986 Proksa et al. ..... 222/135
4,650,119 A * 3/1987 Pomponi, Jr. ..... 239/413
4,925,101 A * 5/1990 Konieczynski et al. ..... 239/415

FOREIGN PATENT DOCUMENTS

WO 9525848 9/1995

* cited by examiner

*Primary Examiner*—Lisa A. Douglas
(74) *Attorney, Agent, or Firm*—Ostrolenk, Faber, Gerb & Soffen, LLP

(57) ABSTRACT

A valve arrangement for distributing or spreading a two-component binder system, comprising a distribution pipe (1) which is intended to be carried by a vehicle and which extends transversely to the movement direction of said vehicle, wherein a first binder component is intended to be conducted through a first conduit or line (101) which includes the pipe (1), wherein a plurality of first valves (60) are connected to the pipe (1) at mutually spaced positions along the length of said pipe and function to deliver the first binder component to distribution nozzles (14) connected to a respective first valve (60), wherein a second conduit or line (313, 26; 313, 35, 36) with an associated second valve (120) for the second binder component connects to each first nozzle (14), and wherein each first valve (60) includes a valve member (6) which is carried by a valve spindle (4) that can be moved to and from a position in which the valve member blocks the first component flow via a valve seat (19, 7) which connects with the nozzle (14). The first valve (60) associated with a nozzle (14) is adapted to control the second valve (120) associated with said nozzle (14).

9 Claims, 4 Drawing Sheets

SPRAY GUN

The present invention refers to a spray gun for mixing and spraying of two media, and of the type incorporating a valve for one medium each.

BACKGROUND AND PROBLEM OF THE INVENTION

Spray guns of the type mentioned above are earlier known, which have two separate valves for one medium each and positioned at some distance from each other and a common mixing chamber. A drawback with these is that when the two media react with each other, the orifices of the valves will be clogged up. To prevent this a careful cleaning is required at every interruption of the spraying operation. A further drawback is that the spray gun will become bulky, is more difficult to handle, has many movable components and therefore requires more maintenance and is more expensive to manufacture than spray guns for one medium only.

PURPOSE OF THE INVENTION AND SOLUTION OF THE PROBLEM

The purpose of the invention is to provide a spray gun, which:

is easy to clean, by wiping it off, prevents contamination of the valve orifices to a large extent, is as easy to handle as spray guns for one medium only, has a few movable components, requires a minimum of maintenance, is worth its price.

These tasks have been solved in that the two valves are provided one inside the other and designed to be axially displaceable in a housing and relative to each other to and from respective valve seats against the action of a spring, and that the valves are actuatable together by an external force.

DESCRIPTION OF THE DRAWINGS

Hereinafter the invention will be further described as an embodiment with reference to the accompanying drawings.

DESCRIPTION OF EMBODIMENT

Figure 1:
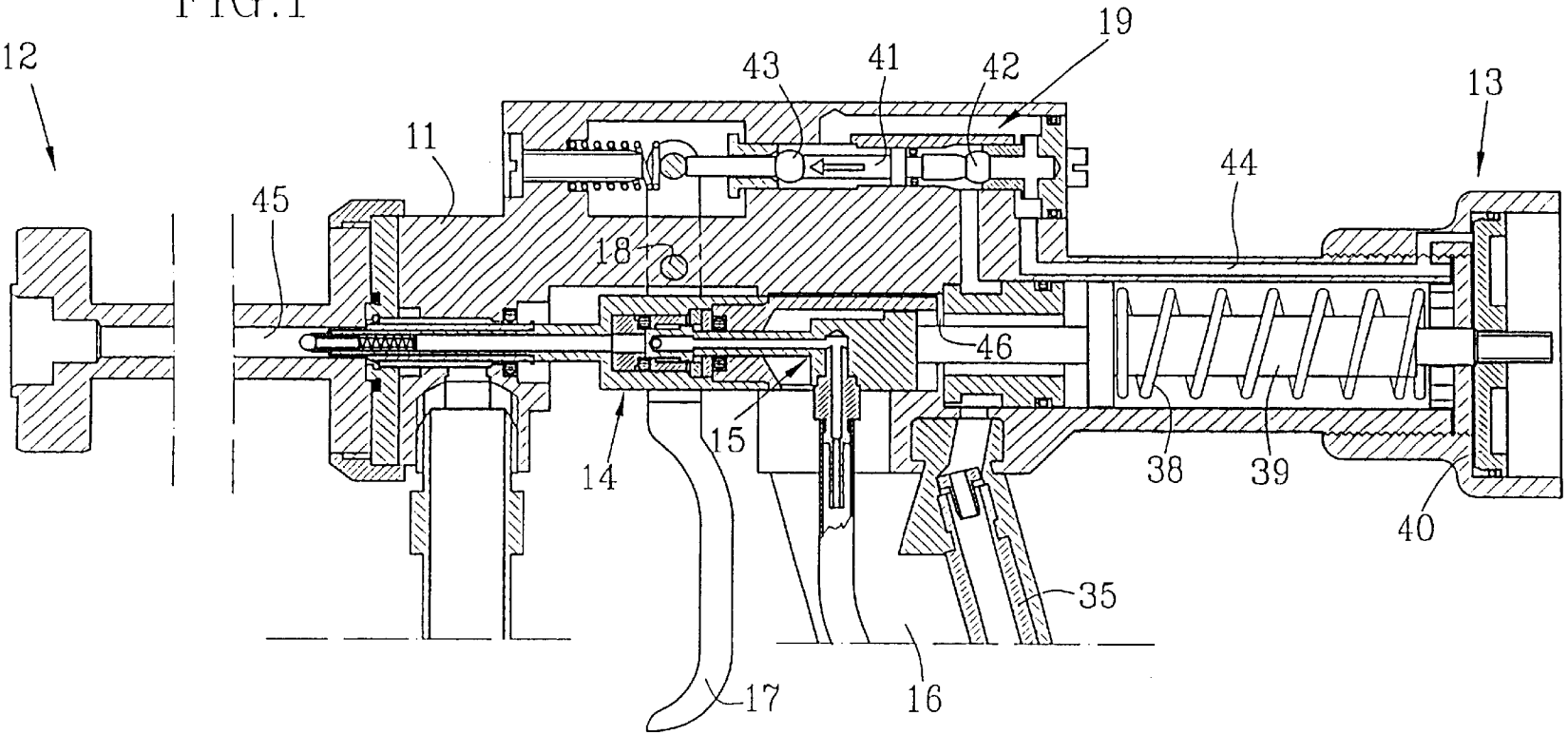
FIG. 1 shows a section through a spray gun according to the invention in closed, passive position.

The spray gun according to the invention consists of a central housing 11, which at its forward part is equipped with a spraying nozzle 12 and at its rearmost portion with a servo mechanism 13. The central housing 11 incorporates two valves 14 and 15, the inner one 15 of which is provided within the other, outer valve 14. The housing also incorporates a handle 16 and in front of this a trigger 17 in the form of a two-armed lever, which is pivotable about a shaft 18. In the upper part of the housing is also provided a valve arrangement 19 for controlling the servo mechanism 13.

The outer valve 14, which is axially displaceable in the housing 11 consists of a sleeve 20, which passes over into a coaxial tube 21, which extends into the spraying nozzle 12. A protective bushing 22 is threaded over the tube 21, and the forward tapering end 23 of which cooperates with a valve seat 24 in the housing 11. At the front end of the tube is provided a non-return valve 25, which opens at a pressure inside the tube. The protective bushing 22 is surrounded by an annular channel 30, which communicates with a supply conduit 31 for a first medium, e.g. polyester. At the transition between the tube 21 and the sleeve 20 is provided a valve seat 26 in the latter, which cooperates with the end surface of the valve body 27 of the inner valve 15. This is constituted by a tube 28, the forward end of which is closed, but provided with lateral openings 29, which communicate with a second annular channel 32, which can be brought in communication with the interior channel 33 of the tube 21, when the valve body 27 is displaced in a direction away from its seat 26 and the opening of the channel 33 is exposed.

The inner valve 15, which is axially displaceable in the sleeve 20 of the outer valve 14, passes over with its tubular valve body 28 into a bush 34, which is guided inside the sleeve 20. The inner channel 36 of the tube 28 opens at this bushing, and a supply conduit 37 for a second medium, e.g. a hardening agent is connected to this channel. A piston rod 39 of a piston 40, forming part of the servo mechanism 13 and being subjected to load by a pressure spring 38 is also attached to the bushing 34.

Figure 2:
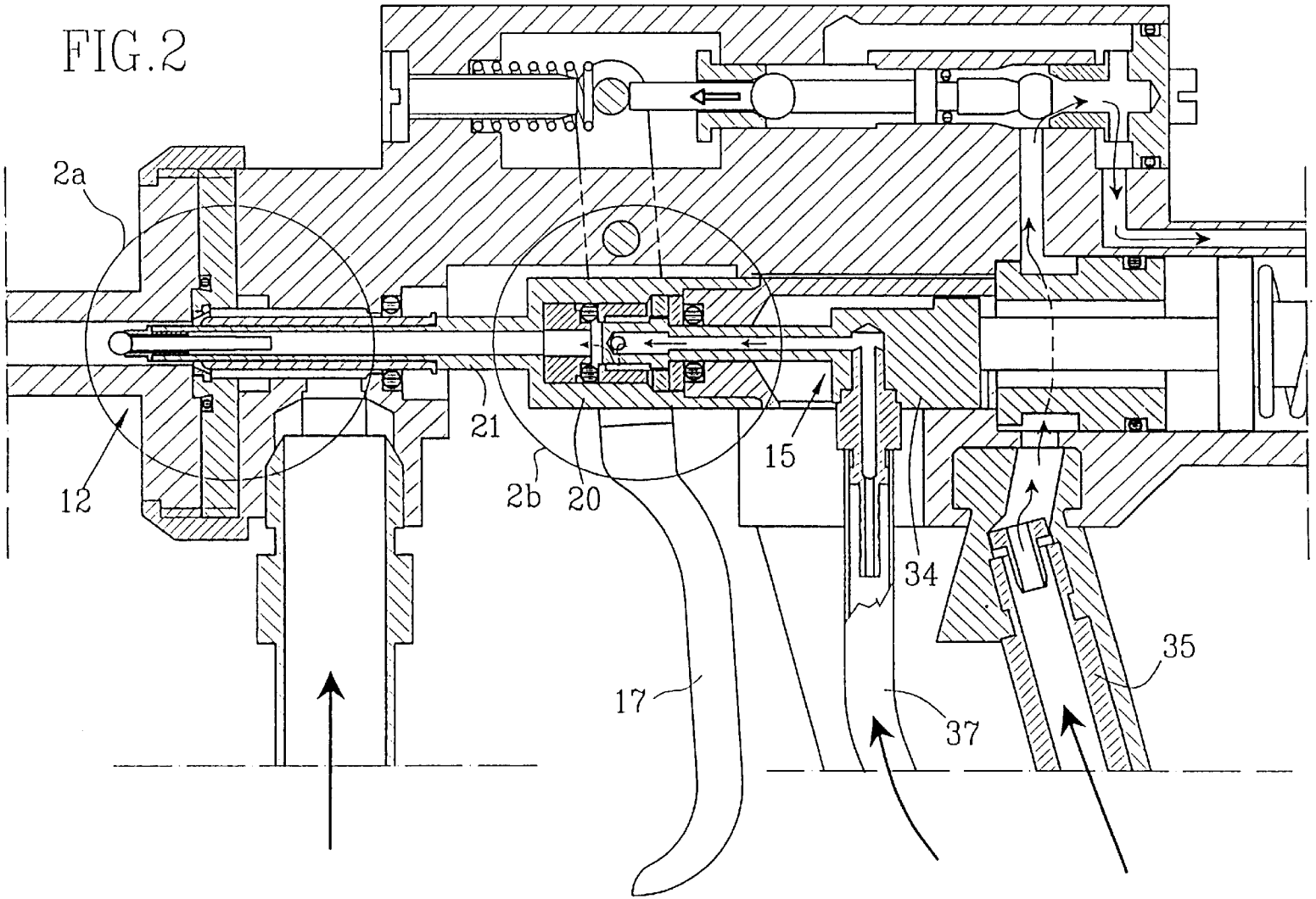
FIG. 2 shows in bigger scale a section through the intermediate portion of the spray gun, with the valves in open, active position.
Figure 2A:
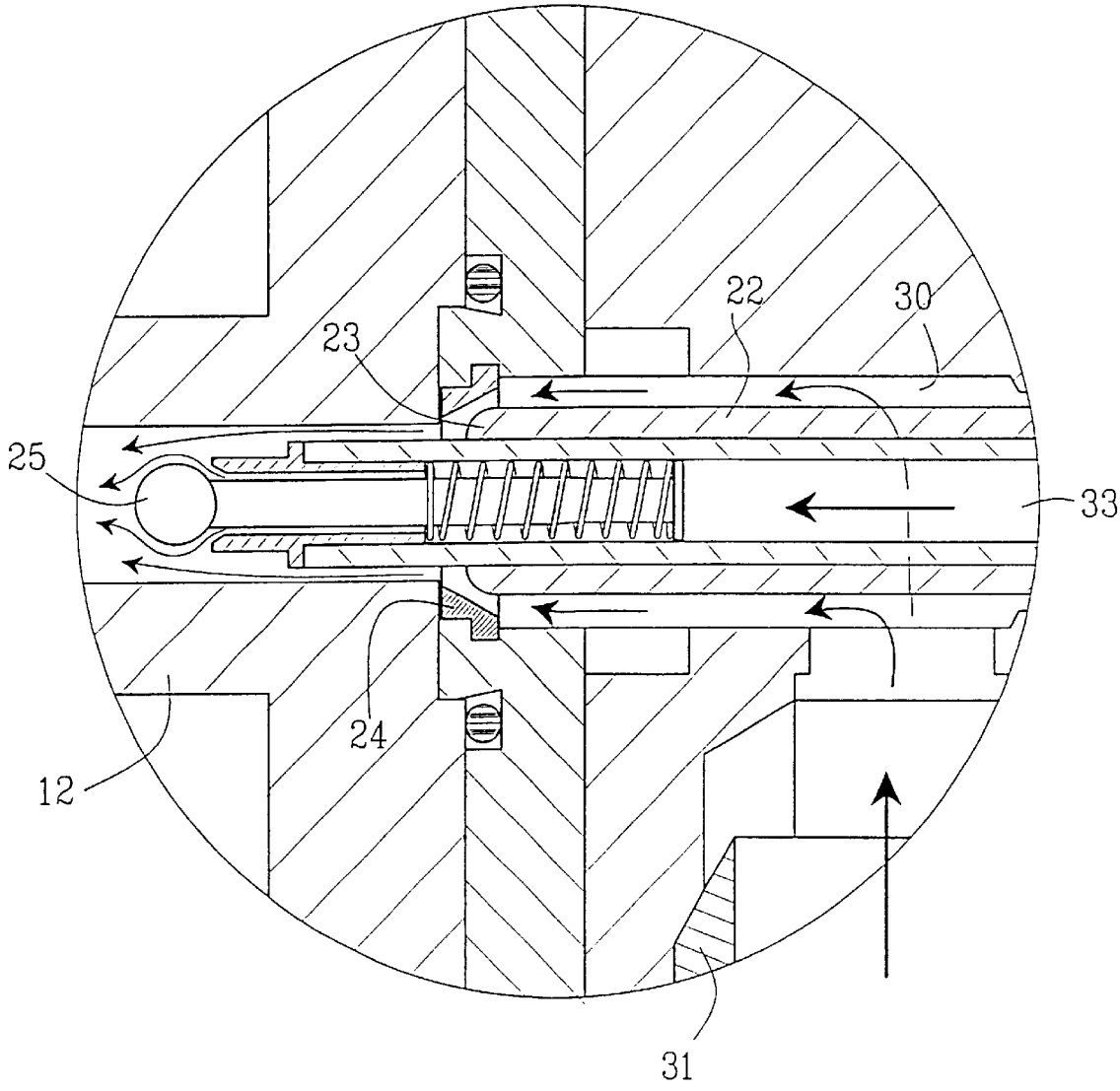
FIG. 2*a* is a partial enlargement of the encircled portion 2*a* from FIG. 2.
Figure 2B:
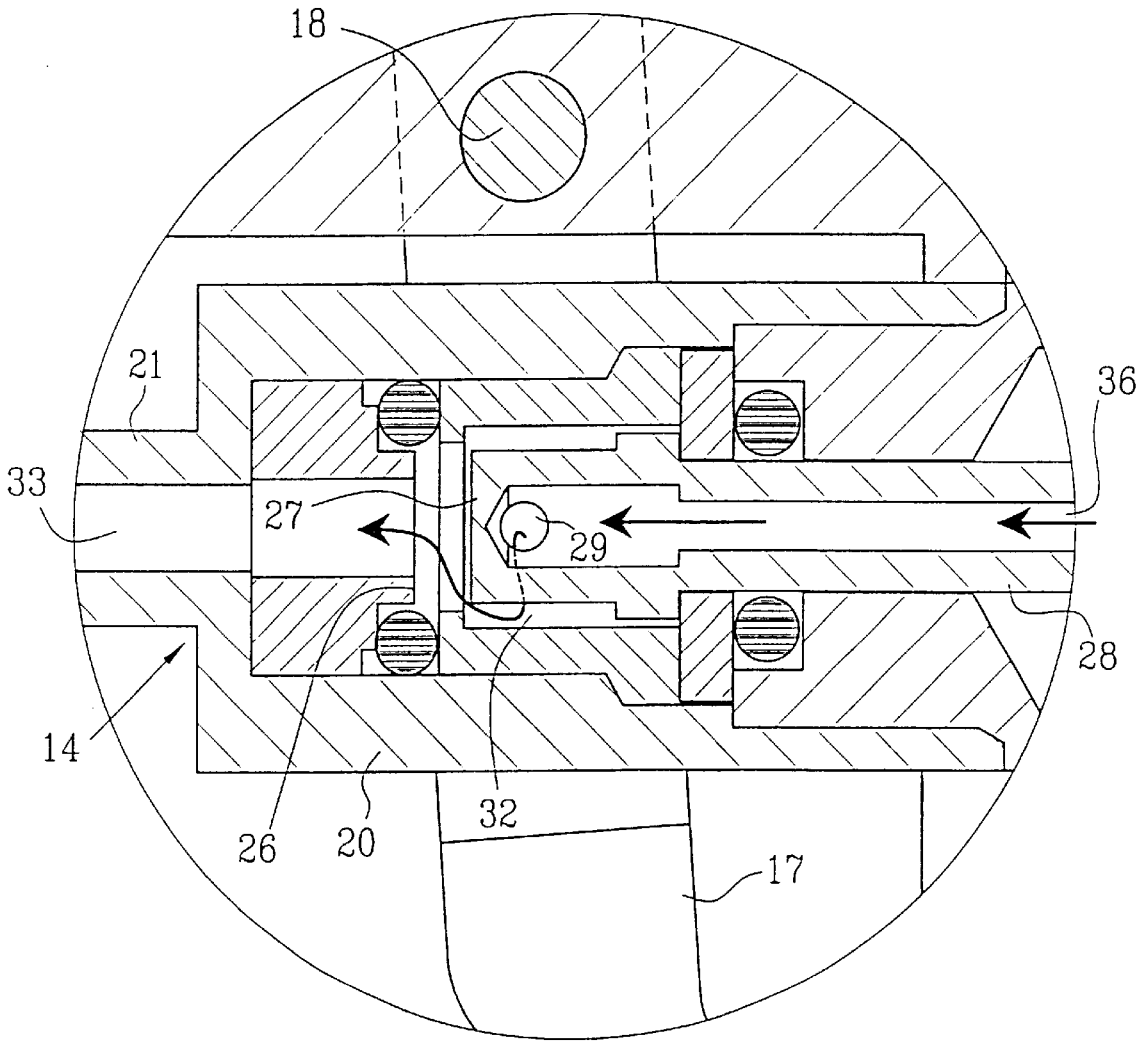
FIG. 2*b* is a partial enlargement of the encircled portion 2*b* from FIG. 2.

A conduit 35 for pressurized air is also connectable to the housing 11, and which supplies pressurized air to a valve stem 41 equipped with two valve bodies 42 and 43, one of which always closes against a valve seat, whereas the other one is open. The position of the valve stem is controlled by means of the trigger 17. When the trigger is acted upon, the valve body 42 opens the passage to an air conduit 44, which leads the pressurized air to the forward side of the piston 40. The piston rod 39 thereby will be subjected to a tensile force acting against the action of the spring 38. The tensile force is transferred to the bushing 34, whereby the entire valve package consisting of the outer and the inner valves 14, 15 is displaced against a stop 46, such as shown in FIG. 2 and 2*a*. In this stage the two valves 14, 15 form an interconnected unit, due to the fact that the second medium contained in the annular slot 32 and the channel 36 is under pressure. In this position the passage beyond the valve seat 24 is opened, thus that the first medium can flow from the supply conduit 31 to the connecting channel 45 of the spray nozzle 12. This channel is designed as a mixing chamber or mixing channel equipped with not shown, for instance screw-shaped, mixing members.

At continued supply of pressurized air to the piston 40 the passage beyond the valve seat 26 will be opened, thus that the second medium can flow from the annular slot 32 to the inner channel 33 of the tube 21 and further to the non-return valve 25, which is thereby opened. Thereby the second medium will reach the mixing chamber 45 and an intimate mixing of the two media can take place.

As the outlet opening for the second medium at 25 is situated somewhat in front of the outlet openings at 24 for the first medium and the first medium always is discharged first, there will not be any contamination at these outlet openings 24. The cleaning then can be limited to wiping off the non-return valve 25, after the spraying nozzle 12 has been screwed off.

What is claimed is:

1. A spray gun for mixing and spraying two media comprising:

a housing extending along a longitudinal axis; a first valve seat in the housing, a second valve seat spaced axially from the first valve seat in the housing, an outer valve mounted on the housing and an inner valve located within the outer valve, the outer and inner valves being displaceable axially in the housing relative to each other;

first and second seat valves provided in the housing and spaced axially from one another;

a spring generating a spring force acting upon the outer and inner valves so that the outer valve and the inner valve press against the first seat and the second seat, respectively, to prevent flow of the two media, the outer and inner valves together are influence able by an external force counteracting the spring force so that when the external force overcomes the spring force, first the outer valve is displaceable from the first valve seat to provide flow of one of the two media into the housing, and then the inner valve is displaceable from the second valve seat to allow flow of the other medium for mixing with the one medium in the housing.

2. A spray gun as claimed in claim 1, wherein the second valve seat of the inner valve is provided in the outer valve.

3. A spray gun as claimed in claim 1, wherein the inner and outer valves during the initial displacement are interconnected hydraulically, each of the outer and inner valves having a valve body displaceable between respective closed and open positions, the valve body of the inner valve being in the closed position thereof during the initial displacement of the outer valve.

4. A spray gun as claimed in claim 1, wherein the external force is constituted by a pneumatically actuatable piston having a piston rod connected to the valve body of the inner valve, which is displaceable in the outer valve, and that the axial displace ability of the outer valve is limited by a stop in the housing and that the valve body of the inner valve is displaceable a little further under the opening of the inner valve.

5. A spray gun claimed in claim 1, wherein a non-return valve, which can be opened by one of the two media discharged through the inner valve, is provided at an outlet orifice of the outer valve.

6. A spray gun as claimed in claim 1, wherein, the outlet orifice of the outer valve is axially spaced from an outlet orifice of the inner valve.

7. A spray gun as claimed in claim 1, wherein the outlet orifices of both outer and inner valves are arranged to open in a common mixing chamber/channel.

8. A spray gun as claimed in claim 4, wherein the movement of the pneumatic piston is controlled by a valve stem, the spray gun further comprising a trigger displaceable between one of two end positions, in which the trigger closes the air supply to the pneumatic piston and simultaneously opens a ventilating opening, and the other end position, in which the trigger opens the air supply and closes the ventilating opening.

9. A spray gun for dispensing a first medium and a second medium comprising:

a housing extending along an axis;

a first valve seat provided in the housing;

an outer valve mounted on the housing and movable axially between a closed position, in which the outer valve presses against the first valve seat to prevent flow of the first medium through the housing, and an open position to provide flow of the first medium in the housing;

a second valve seat provided in the housing and spaced axially from the first valve seat;

an inner valve mounted within the outer valve and movable axially relative to the outer valve between a closed position, in which the inner valve urges against the second valve seat to block flow of the second medium through the housing, and a respective open position;

a spring mounted in the housing and generating a spring force acting upon the outer and inner valves so that the outer and inner valves are displaced in respective closed positions; and a controller mounted on the housing for actuating the outer and inner valves to move against the spring force so that initially the first valve is displaced in the open position thereof, and subsequently the second valve is displaced in the open position thereof to provide flow of the second medium mixing with the first medium in the housing.

* * * * *